US008074744B2

(12) United States Patent
Watson et al.

(10) Patent No.: US 8,074,744 B2
(45) Date of Patent: Dec. 13, 2011

(54) HORIZONTAL WATERJET DRILLING METHOD

(75) Inventors: Marshall Charles Watson, Midland, TX (US); Joseph Straeter, Evansville, IN (US)

(73) Assignee: ACT Operating Company, Midland, TX (US)

( * ) Notice: Subject to any disclaimer, the term of this patent is extended or adjusted under 35 U.S.C. 154(b) by 0 days.

(21) Appl. No.: 12/749,295

(22) Filed: Mar. 29, 2010

(65) Prior Publication Data

US 2010/0181113 A1 Jul. 22, 2010

Related U.S. Application Data

(63) Continuation-in-part of application No. 12/276,844, filed on Nov. 24, 2008, now Pat. No. 7,690,444.

(51) Int. Cl.
*E21B 7/18* (2006.01)

(52) U.S. Cl. ..... 175/67; 175/62; 175/78

(58) Field of Classification Search ..... 175/62, 175/78, 67

See application file for complete search history.

(56) References Cited

U.S. PATENT DOCUMENTS

| | | | |
|---|---|---|---|
| 5,413,184 | A | 5/1995 | Landers |
| 6,138,777 | A | 10/2000 | Fraim et al. |
| 6,470,978 | B2 | 10/2002 | Trueman et al. |
| 6,487,782 | B1 | 12/2002 | Bond |
| 6,915,853 | B2 | 7/2005 | Bakke et al. |
| 7,264,048 | B2 | 9/2007 | Zupanick et al. |
| 7,357,182 | B2 | 4/2008 | Hunt et al. |
| 7,370,710 | B2 | 5/2008 | Trueman et al. |
| 7,690,444 | B1 | 4/2010 | Watson et al. |
| 2003/0192719 | A1 | 10/2003 | Nackerud |
| 2005/0034901 | A1 | 2/2005 | Meyer |
| 2005/0067166 | A1 * | 3/2005 | Trueman et al. ..... 166/313 |

OTHER PUBLICATIONS

Iyoho, A.W., et al., "Petroleum Applications of Emerging High-Pressure Waterjet Technology," Oct. 3-6, 1993, SPE Annual Technology Conference and Exhibition, Houston, TX, 8 pages.

Summers, D.A., et al., "Water Jet Cutting of Sedimentary Rock," Jul. 1972, Journal of Petroleum Technology, 6 pages.

Forman, S.E., et al., "The Mechanics of Rock Failure Due to Water Jet Impingement," Jan. 3, 1973, SPE-AIME Sixth Conference on Drilling and Rock Mechanics, Austin, TX, 9 pages.

Summers, D.A., et al., "Waterjetting Technology," 1995, 1st ed, London: New York: E&FN Spoon. xvi, 23 pages.

Dickinson, W., et al., "Multiple Radials Multiply Recovery," Feb. 12-17, 1995, 6th UNITAR International Conference on Heavy Crude and Tar Sands, Houston, Texas, 9 pages.

Kennerley, T., "Development of a High Pressure Water Jet Drilling System for Coal Seams," Jan. 1990, Thesis for Masters of Engineering Science, University of Queensland, Queensland, Australia, 83 pages.

Byrne, W.E., "Composite Bridge Plug Technology for Coalbed Methane Increases Efficiency and Reduces Costs of Completing CBM Wells," 2007 International Coalbed Methane Symposium, Baker Oil Tools, pp. 1-9.

* cited by examiner

*Primary Examiner* — Jennifer H Gay
*Assistant Examiner* — Yong-Suk Ro
(74) *Attorney, Agent, or Firm* — Edmonds & Nolte, PC

(57) ABSTRACT

A method and apparatus for completing a lateral channel in a subterranean formation using a flexible hose with a waterjet that may be directed down a well casing and into a waterjet guide. The waterjet guide has a diverter assembly configured to receive and divert the flexible hose in a shortened radius. The diverter assembly includes an inlet curvature and a pivot curvature, where the pivot curvature pivots between stowed and deployed configurations in response to forces provided through a mandrel assembly communicably coupled thereto.

16 Claims, 4 Drawing Sheets

HORIZONTAL WATERJET DRILLING METHOD

CROSS-REFERENCE TO RELATED APPLICATIONS

The present application is a continuation-in-part of co-pending U.S. patent application Ser. No. 12/276,844 entitled "Horizontal Waterjet Drilling Method," filed on Nov. 24, 2008. The contents of which are herein incorporated by reference in their entirety.

BACKGROUND OF THE INVENTION

Horizontal waterjet drilling is used in the oil and gas industry to access hydrocarbons located at specific depths below the earth's surface. To illustrate, oil and gas wells are typically drilled by the use of rotary drilling equipment vertically into the earth's strata. The vertically extending well holes generally include a casing made of mild steel which defines the cross-sectional area of a well for transportation of the oil and gas upwardly to the earth's surface. However, these vertically extending wells are only useful for removing oil and gas from the general vicinity adjacent to and directly underneath the terminating downward end of the well. Thus, not all of the oil and gas in the pockets or formations in the Earth's strata, at the location of the well depth, can be removed.

Because it is time-consuming and costly to make adjacent vertical drillings to access remaining hydrocarbons, the borehole casing of an existing oil or gas well is penetrated and then a lateral channel is bored through the adjacent formation of interest using a high pressure waterjet nozzle. High-pressure hoses and waterjets are required to pass through extremely tight areas to reach the formation of interest, seemingly requiring a more flexible, smaller inner-diameter hose that can reduce overall fluid pressures. A reduction in fluid pressure results in inadequate cutting power from the waterjet nozzle and, therefore, reduced drilling capacity.

Therefore, it remains desirable to find improved waterjet cutting methods that may be practiced in small areas and yet still allow for substantial high-pressure fluid pumping flow rates. It also remains desirable to find new and improved devices that aid the high-pressure hose in moving from a vertical disposition to a horizontal disposition without compromising the integrity or flow rate of the hose.

SUMMARY OF THE DISCLOSURE

The present disclosure relates to an improved method for waterjet drilling into the earth's strata surrounding a well casing thereby enhancing the production of hydrocarbons, such as coalbed methane, that commonly flows from the fractures in such formations. More specifically, the present disclosure relates to an improved method for drilling a lateral channel into a formation of interest where the combination of a flexible hose and a waterjet is fed into an improved waterjet guide and capable of entering the formation of interest at short radii without significantly reducing the required cutting fluid pressure. As will be appreciated, however, the various embodiments disclosed herein may also be used for drilling into other media, such as carbonates, sandstones, and concrete.

Embodiments of the disclosure may provide a waterjet guide. The waterjet guide may include an elongated housing having a first end and a second end, the elongated housing being configured to re-direct a flexible hose, and a tube plate disposed within the elongated housing proximate the first end, and a stop plate disposed within the elongated housing proximate the second end. The waterjet guide may further include a diverter assembly disposed between the tube plate and the stop plate, the diverter assembly having an inlet curvature mounted adjacent the tube plate and a pivot curvature pivotally coupled to the elongated housing, and a mandrel slidingly engaged within a barrel defined in the second end of the elongated housing, wherein the mandrel has a pivot end and a threaded end. The waterjet guide may also include a pivotable connector coupled to the pivot end of the mandrel and also coupled to the pivot curvature, whereby movement of the mandrel within the barrel forces the pivotable connector to pivot the pivot curvature between a stowed configuration and a deployed configuration.

Embodiments of the disclosure may further provide a method of drilling a lateral channel in a subterranean formation adjacent an existing wellbore. The method may include suspending a waterjet guide in the wellbore adjacent the subterranean formation, the waterjet guide having a diverter assembly disposed therein, wherein the diverter assembly has an inlet curvature mounted to the waterjet guide and a pivot curvature pivotally coupled to the waterjet'guide. The method may further include actuating the diverter assembly to pivot the pivot curvature into a deployed configuration where the inlet and pivot curvatures form a curved transition surface, and directing a flexible hose terminating at a waterjet down the wellbore and into the waterjet guide, wherein the diverter assembly receives and re-directs the flexible hose and waterjet out of the waterjet guide and into the subterranean formation. A fluid may then be pumped through the flexible hose and waterjet to create the lateral channel.

Embodiments of the disclosure may further provide a waterjet guide assembly. The assembly may include a housing having first and second ends, and a diverter assembly disposed between the first and second ends, the diverter assembly having an inlet curvature mounted to the housing and a pivot curvature pivotally coupled to the housing, wherein the inlet and pivot curvatures are configured to cooperatively form a curved transition surface for a flexible hose when the diverter assembly is in a deployed configuration. The assembly may further include a mandrel assembly slidingly engaged with the second end of the housing, the mandrel assembly being configured to move the diverter assembly between a stowed configuration and the deployed configuration.

DETAILED DESCRIPTION

Figure 1:
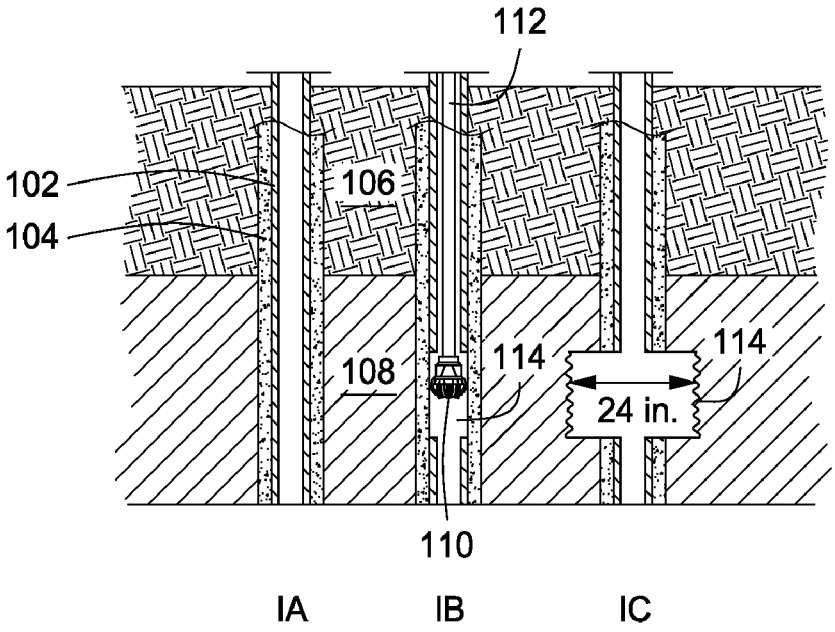
FIG. 1 (PRIOR ART)
FIGS. 1A-1C are side views illustrating progressing operations to perforate a well casing.

It is to be understood that the following disclosure describes several exemplary embodiments for implementing different features, structures, or functions of the invention. Exemplary embodiments of components, arrangements, and configurations are described below to simplify the present disclosure, however these exemplary embodiments are provided merely as examples and are not intended to limit the scope of the invention. Further, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring now to the drawings, there is shown in FIG. 1 a conventional cement and steel encased oil or gas well, having a steel well casing 102, an annular cement encasement 104, and showing the earth strata 106 and a surrounding subterranean formation 108. In at least one embodiment, the surrounding formation can include a coal seam formation. As will be appreciated, however, the surrounding formation 108 can also include any type of reservoir that can contain hydrocarbons (e.g., oil or gas). For example, surrounding formations 108 may include, but are not limited to, sandstones, carbonates, and even solid rock or concrete mediums.

To access the formation 108, the well casing 102 and encasement 104 must first be perforated. To accomplish this, a casing mill 110 may be suspended in the well casing 102 to a selected depth where the formation 108 is known to exist, as illustrated in FIG. 1B. The casing mill 110 may be connected to the distal end of a drill string 112, or tubing string. On the surface, the drill string 112 may be connected to a top drive or a reverse unit (not shown) capable of supplying the rotational force or torque needed to excise a section of the casing 102. The reverse unit may also include a pump capable of supplying drilling fluid or water at a desired rate and pressure.

In an exemplary embodiment including a typical 5.5 in. well casing 102, the casing mill 110 blades may be 6.25 in. in diameter, sufficient to perforate the well casing 102 and at least a portion of the surrounding concrete encasement 104. In exemplary operation, as the casing mill 110 rotates, its blades will degrade or cut through the well casing 102 about its entire circumference along a 360° path, thus yielding a circular perforation 114. In exemplary operation, the casing mill 110 may be vertically translated to perforate the casing to a height of about 4 ft in a cylindrical configuration.

Figure 2:
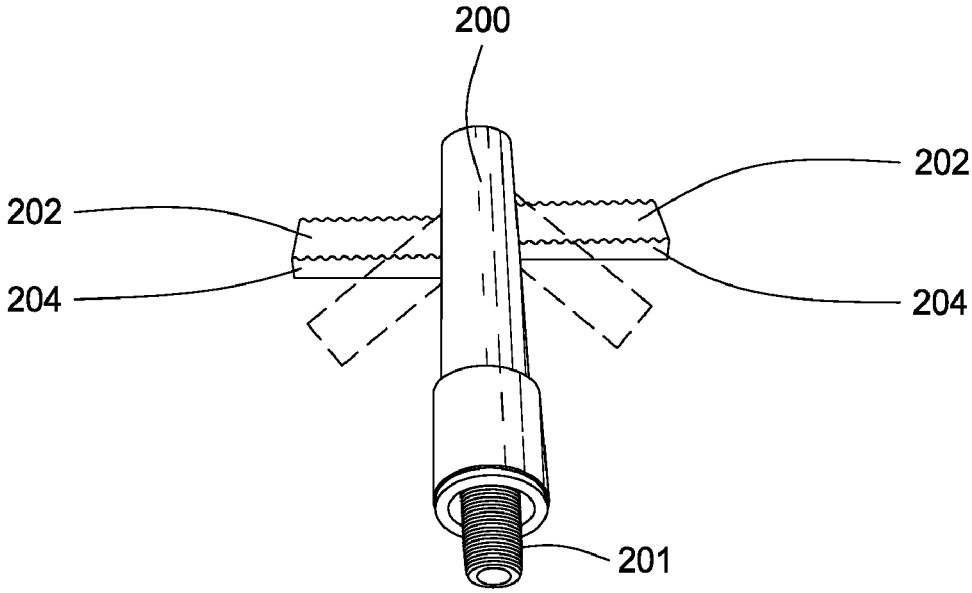
FIG. 2 is a perspective view of an exemplary underreamer according to one or more aspects of the present disclosure.

The perforation 114 may then be underreamed to extend and simultaneously enlarge the perforation 114 into the formation 108. FIG. 2 illustrates an exemplary underreamer 200 suitable for the present disclosure. Once the casing mill 110 is removed, the underreamer 200 may be lowered to the perforation 114. The underreamer 200 may be attached to the distal end of the drill string 112 (FIG. 1) via a threaded engagement 201 at its base. It may also include a pair of flush-mounted cutting blades 202 that are pivotally connected to the underreamer 200 body. In at least one embodiment, the cutting blades 202 may be capable of cutting through the concrete encasement 104 and the surrounding formation 108.

Moreover, multiple cutting jets 204 may be situated along the length of the cutting blades 202 and configured to provide high-pressure fluidic release also capable of cutting through the formation 108. By design, the cutting blades 202 may pivotally extend outward with respect to the underreamer 200 body in response to hydraulic pressure through the cutting blades 202 and/or the resultant centrifugal forces occurring through high-speed rotation of the drill string 112.

In at least one embodiment, the underreamer 200 may be capable of removing the cement encasement 104 and also enlarging the circular perforation 114 to a diameter of 20-30 in. with respect to the casing 102. As illustrated in FIG. 1C, an exemplary embodiment may include underreaming the perforation 114 to a diameter of about 24 in., and a height of about 4 ft.

Figure 3A:
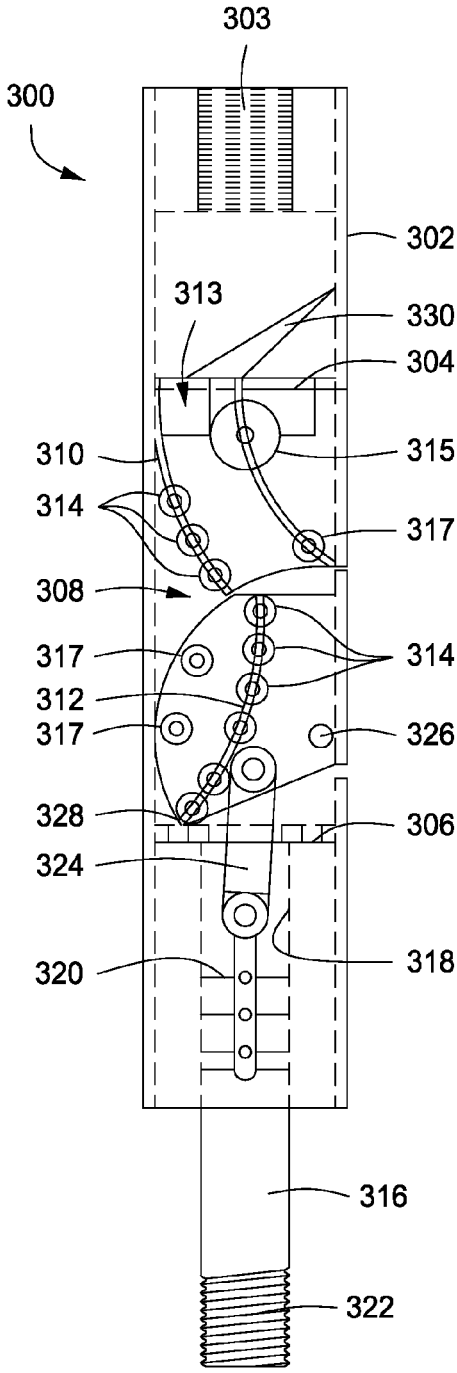
FIG. 3A is a cross-sectional view of a waterjet guide in a stowed position, according to one or more aspects of the present disclosure.
Figure 3B:
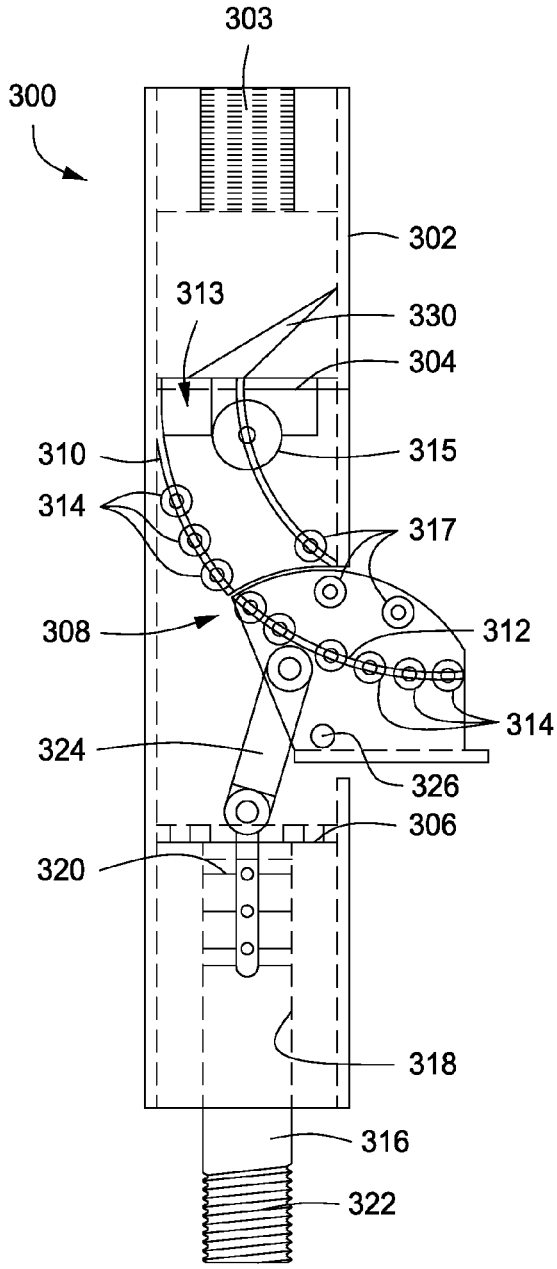
FIG. 3B is cross-sectional view of a waterjet guide in a deployed position, according to one or more aspects of the present disclosure.

Referring now to FIGS. 3A and 3B, once the underreamer 200 is removed from the casing 102 (FIG. 1), a waterjet guide 300 may be lowered to the depth of the circular perforation 114. FIG. 3A illustrates the waterjet guide 300 in a first or stowed configuration that allows the guide 300 to be inserted into the well casing 102. FIG. 3B illustrates the waterjet guide 300 in a second or deployed configuration.

In one or more embodiments, the waterjet guide 300 may include an elongated housing 302 having a tube plate 304 and a stop plate 306 disposed therein. As illustrated, the tube plate 304 and the stop plate 306 can be vertically-offset but disposed generally parallel to each other. In at least one embodiment, the housing 302 may be substantially cylindrical and be made of a rigid material, such as aluminum, steel, hardened polymers, combinations thereof, or the like. The housing 302 may also include a threaded bore 303 at the top whereby the waterjet guide 300 can be threadably connected to the drill string 112 (FIG. 1) and thereby be lowered into the casing 102.

Interposed between the tube plate 304 and the stop plate 306 may be a diverter assembly 308. The diverter assembly 308 may be configured to receive and divert a flexible high-pressure hose 402 (FIG. 4) into the surrounding formation 108, as will be described below. In an exemplary embodiment, the diverter assembly 308 may include an inlet curvature 310 and a pivot curvature 312, wherein the inlet curvature 310 is mounted or otherwise attached to the tube plate 304 and the pivot curvature is pivotally coupled to the housing 302 at pivot pin 326. In at least one embodiment, a plurality of roller bearings 314 may be disposed on or form part of each curvature 310, 312. However, in other embodiments, the curvatures 310, 312 may instead provide a smooth, curved surface adapted to re-direct or divert the flexible high-pressure hose 402 into the surrounding formation 108. As can be appreciated, in embodiments without roller bearings 314, the curvatures 310, 312 may rely on wet friction to receive and divert the hose 402 into the surrounding formation 108.

In at least one embodiment, the roller bearings 314 may be saddle-type bearings adapted to seat and rollingly engage the hose 402 (FIG. 4) as it is being fed into or out of the waterjet guide 300. In one embodiment, the roller bearings 314 may be made of a polymer, such as elastomers, plastics, and/or nylon materials. In other embodiments, the roller bearings 314 may be made of a rigid material, such as metal or hardened rubber.

The diverter assembly 308 may also include at least one translation roller 315 disposed proximate the tube plate 304, and at least one guide roller 317. In one or more embodiments, the translation roller 315 and/or the guide roller(s) 317 may be disposed opposite the roller bearings 314 and adapted to maintain alignment and help facilitate smooth movement of the hose 402 (FIG. 4) as it is being moved within the waterjet guide 300. For example, the translation roller 315 may help guide the hose 402 into the diverter assembly 308 and also protect the hose 402 from coming into contact with a sharp edge of the tube plate 304 upon being retracted through the waterjet guide 300.

Likewise, the guide roller(s) 317 may be configured to help direct and maintain the hose 402 within the diverter assembly 308 and protect it from sharp edges that may be present on the top-side of the curvatures 310, 312. Moreover, the high pressures incident in the high-pressure hose 402, coupled at its end to a waterjet nozzle 410 (see FIGS. 4 and 5), may force the combination of the hose 402 and nozzle 410 into erratic movement. Thus, in at least one embodiment, the guide roller (s) 317 may counteract hose 402 movement and help maintain the waterjet nozzle 410 in a horizontal configuration as it enters an adjacent formation 108.

Although the translation roller 315 is illustrated as a larger roller when compared to the roller bearings 314 or the guide roller 317, it will be appreciated that any size translation roller 315 can accomplish the same objectives. Moreover, it will be further appreciated that more than one translation roller 315 and/or guide roller 317 may be used without departing from the present disclosure.

In one or more embodiments, the waterjet guide 300 may further include at least one guide plate 330 disposed proximate the tube plate 304 within the housing 302. The guide plate 330 may be disposed at an angle with respect to horizontal and configured to direct the hose 402 (FIG. 4) through an opening 313 in the tube plate 304 and into the inlet curvature 310. In at least one embodiment, the guide plate 330 may be an angular plate or a pair of rigid plates welded or otherwise affixed to the interior of the housing 302.

The waterjet guide 300 may also include a mandrel 316 adapted to translate axially within a barrel 318 defined within the housing 302. In an embodiment, the mandrel 316 may be adapted to slidingly engage the inner surface of the barrel 318. The mandrel 316 may include a pivot end 320 and a threaded end 322. In at least one embodiment, the pivot end 320 may be coupled or otherwise attached to a pivotable connector 324. As illustrated, the pivotable connector 324 may also be connected or otherwise attached to the pivot curvature 312 and adapted to force the pivot curvature 312 to pivot about the pivot pin 326, thereby moving the pivot curvature 312 from stowed to deployed configurations, and back again.

To accomplish this, upward translation of the mandrel 316 within the barrel 318 may force the pivotable connector 324 to pivot the pivot curvature 312 about the pivot pin 326, thereby moving it into the deployed position, as shown in FIG. 3B. In at least one embodiment, the pivot curvature 312 may pivot until the pivot end 320 of the mandrel 316 comes into contact with the stop plate 306. The mandrel 316 may be designed so that when the pivot end 320 comes into contact with the stop plate 306, a smooth and curved transition surface is generated from the inlet curvature 310 to the pivot curvature 312. As illustrated in FIG. 3B, a portion of the pivot curvature 312 may extend outside the housing 302 when in the deployed position.

Likewise, downward translation of the mandrel 316 within the barrel 318 may force the pivotable connector 324 to pivot the pivot curvature 312 about the pivot pin 326 and into its stowed position, as depicted in FIG. 3A. In one or more embodiments, the stop plate 306 may be further configured to prevent over-rotation of the pivot curvature 312 toward the stowed position by having at least a portion 328 of the pivot curvature 312 bottom-out against the stop plate 306, thereby stopping its rotation.

Figure 4:
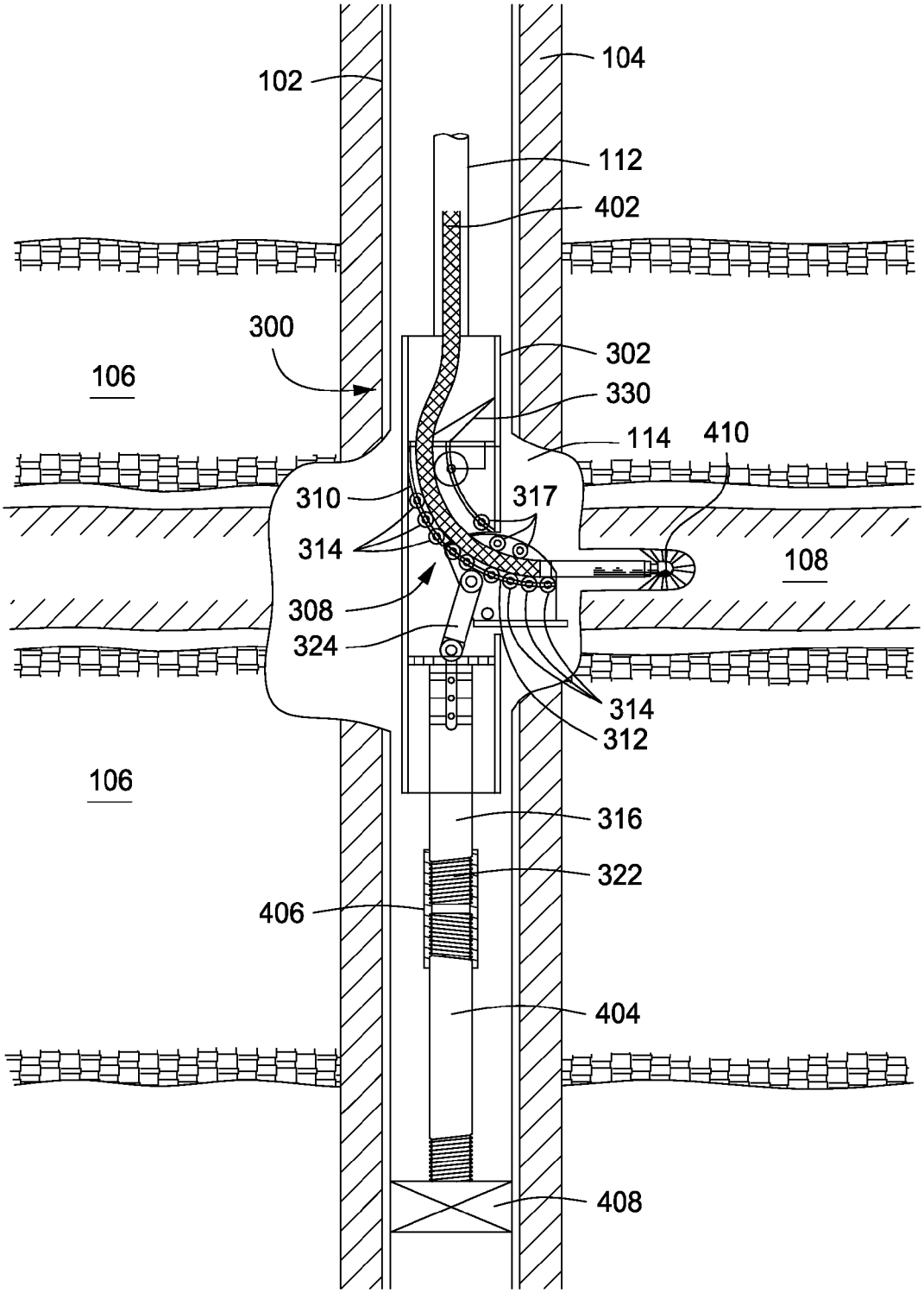
FIG. 4 is a cross-sectional view of drilling a lateral channel in a formation of interest, according to one or more aspects of the present disclosure.

Referring now to FIG. 4, depicted is an embodiment having a flexible high-pressure hose 402 disposed within the waterjet guide 300 and diverted by the diverter assembly 308 into a surrounding formation 108. In one or more embodiments, the mandrel 316 may be coupled or otherwise attached to a spacing tubular 404. As illustrated, the spacing tubular 404 may be coupled to the threaded end 322 of the mandrel 316 via a threaded coupling 406. In other embodiments, however, the spacing tubular 404 may be directly threaded to the threaded end 322 of the mandrel 316 or the mandrel 316 may be configured to extend axially and take the place of the spacing tubular 404 altogether, without departing from the scope of the disclosure. The weight of the mandrel 316 and/or the spacing tubular 404 pulling down on the pivotable connector 324 can serve to maintain the waterjet guide 300 in the stowed position as it descends the length of the casing 102.

In at least one embodiment, during descent of the waterjet guide 300 the spacing tubular 404 may be configured to come into contact and bias a plug 408 disposed in the casing 102 below the circular perforation 114. Besides stopping the descent of the waterjet guide 300, biasing the spacing tubular 404 against the plug 408 may also serve to force the pivotable connector 324 to rotate the pivot curvature 312 into the deployed position.

The plug 408 may be any type of casing isolation device such as, but not limited to, a cast iron bridge plug, a cement plug, a lock set plug, a retrievable plug, a lockset packer, a cup packer, a swell packer, a total depth plug, a plugged back total depth plug, a sand fill plug, a brush-type plug, or the like. In one embodiment, the plug 408 may be engaged at a predetermined or known distance below the circular perforation 114 in the casing 102. Therefore, the length of the spacing tubular 404 may be designed to engage the plug 408 at the known distance, thereby deploying the waterjet guide 300 at the circular perforation 114 and directed into the surrounding formation 108.

Still referring to FIG. 4, once the waterjet guide 300 is in its deployed position, a waterjet 410, coupled to the flexible high-pressure hose 402, can be directed down the drill string 112 and fed into the housing 302. In an embodiment, the drill string 112 can be tubing string adapted to reduce the amount of buckling that the high-pressure hose 402 may undergo as it is being forced down the wellbore either mechanically or manually. In one embodiment, the tubing string may have an outside diameter ranging from about 2 inches to about 3.5 inches, and an inside diameter ranging from about 1.5 inches to about 3 inches.

In other embodiments, the waterjet 410 and hose 402 can be positioned at least partially within the housing 302 prior to descent into the casing 102. As described above, the guide plate 330 may be configured to direct the hose 402 into the inlet curvature 310, and the roller bearings 314 may protect the hose 402 by providing a rolling engagement to direct the hose 402 as it translates within the housing 302. Once the diverter assembly 308 pivots into its deployed configuration, the waterjet guide 300 may provide an exit from the housing 302 via the pivot curvature 312 and into the adjacent formation 108.

In an exemplary embodiment, the commercially-available StoneAge® Banshee™ series BN 18 may be employed as a suitable waterjet 410. The BN 18 waterjet 410 consists of a 0.69 in. diameter body with a 0.375 in. inside diameter and a length of 3.8 in. Because of the small size of the waterjet 410 and the flexibility of the hose 402, the combination waterjet 410 and hose 402 may pass through a tight radius without sacrificing the required fluid pressure to work effectively. In particular, the waterjet 410 and hose 402 combination may be capable of turning the approximate 90° corner in the waterjet guide 300 (i.e., from the vertical drill string 112 to a horizontal configuration) in a radius of about 12 in. as required by the 24 in. reamed-out perforation 114 described above. However, other waterjets 410 may be used which may shorten the tool, thereby enabling it to turn an even shorter radius, for example in a radius of about 7 in., while maintaining the required fluid pressures and thrust to effectively complete the drilling operations herein disclosed. Moreover, any number of waterjets 410 can be used without departing from the scope of the disclosure.

Figure 5:
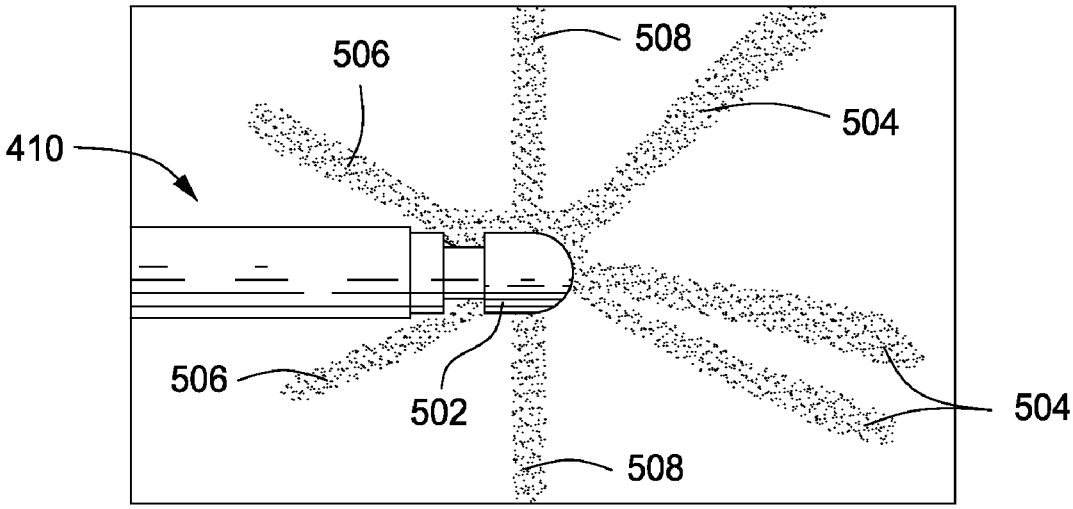
FIG. 5 depicts an exemplary waterjet, according to one or more aspects of the present disclosure.

Referring now to FIG. 5, an exemplary waterjet 410 may include a self-rotating nozzle 502 in fluid communication with a plurality of forward jets 504, a plurality of retro jets 506, and a plurality of radial jets 508. Applications employing more retro jets 506 than forward jets 504 typically result in a rearward volume differential leaving the operator with less cutting volume at the front of the nozzle 502. Since increased forward cutting volume is desired, embodiments of the present disclosure may employ more forward jets 504 than retro jets 506. For example, as illustrated in FIG. 5, an exemplary nozzle 502 may include three forward jets 504, two retro jets 506, and two radial jets 508, thus making the forward jets 504 more numerous than the retro jets 506. However, as can be appreciated, any combination of jets 504, 506, 508 can be implemented without departing from the scope of the disclosure, including plugging one or more jets 504, 506, 508 to suit a particular application.

Each jet 504, 506, 508 may consist of a conduit machined or otherwise formed into the nozzle 502. In an exemplary embodiment, the forward jets 506, generally located on the tip of the self-rotating nozzle 502, may be designed to "cross over" during nozzle 502 rotation to prevent coning of the formation 108, as is known in the art. In other embodiments, however, the forward jets 506 need not cross-over to accomplish a similar end, and instead their angular configuration can be adapted to prevent coning. The retro jets 506 may be evenly spaced about the tail end of the nozzle 502 and angled at about 140° relative to the waterjet 410 body. The radial jets 508 may be equidistantly spaced around the circumference of the nozzle 502 and directed substantially perpendicular so as to ream the channel during forward progression.

With the waterjet 410 substantially in engagement with the formation 108, fluid maintained at a high pressure may be pumped through the flexible hose 402 and into the waterjet 410. In an exemplary embodiment, the waterjet 410 may use a high-pressure drilling fluid. In one embodiment, clean water is used as a drilling fluid. The self-rotating nozzle 502, working on a constant-volume process, accelerates the fluid to a higher-velocity in order escape the nozzle 502, thus propelling the fluid into a coherent stream, or jet, directed toward a target surface to be cut.

In an exemplary embodiment of operation, the nozzle 502 may pass a proportion of the fluid into the forward jets 504 and radial jets 508 resulting in the reaming or cutting-away of the adjacent and surrounding formation 108. A proportion of fluid may also be passed into the retro jets 506 resulting in a collective forward thrust on the waterjet 410 as the pressurized fluid is constantly biased against the rearward formation 108. The retro jets 506 may also serve to remove cuttings and debris from the newly carved orifice in the formation 108.

Although somewhat flexible, the rigidity of the hose 402 may allow an operator on the surface to be able to manually manipulate the location of the waterjet 410, thereby compensating for the lack of forward thrust as a result of less numerous retro jets 506. For example, a downward force on the hose 402 may be manually-applied to assist the less-numerous retro jets 506 with forward thrust. Thus, an operator at the surface is capable of providing the maximum amount cutting force from the more numerous forward jets 504, while not relying solely on the forward thrust of the less numerous retro jets 506. Moreover, an operator may manually translate the waterjet 410 back and forth within the lateral channel to not only increase forward thrust, but also to flush out drilling particulates.

During exemplary drilling operations, the hose 402 may be fed continuously from a drum located at the surface until a lateral channel of desired length has been completed in the formation 108. At which point the hose 402 may be withdrawn at least to a sufficient extent to withdraw the waterjet 410 from the newly bored lateral channel. If it is desired to complete more than one lateral channel at the same depth, then the waterjet guide 300 is simply rotated axially a distance from the previously completed lateral channel and the process is repeated for a second lateral channel, and a third, and so on. It will be evident that one may complete multiple lateral channels into the formation 108 at a given depth without having to repeat a well perforating operation.

Referring again to FIG. 4, as can be appreciated, once waterjet drilling operations have ceased and the waterjet guide 300 begins its ascent, the spacing tubular 404 is removed from contact with the plug 408. The weight of the mandrel 316 and/or spacing tubular 404 may then again pull down on the pivotable connector 324, thereby pivoting the pivot curvature 312 back into the stowed position. In its stowed position, the waterjet guide 300 can ascend the casing 102 without obstruction.

Applicants have reached and applied several conclusions that optimize horizontal coal seam drilling methods. Such conclusions are detailed extensively in the Ph.D. dissertation in petroleum engineering entitled "Optimizing Coalbed Methane Production in the Illinois Basin," authored by Marshall Charles Watson, B.S., M.S. and submitted to the Graduate Faculty of Texas Tech University in May 2008. The dissertation is hereby incorporated by reference in its entirety to the extent that it is not inconsistent with the present disclosure. By way of explanation, and without being bound by any theory, a few of the optimizations reached in the incorporated dissertation are as follows:

In an exemplary embodiment, methods of the present disclosure may be carried out at a depth of about 500-1200 ft. or more below the earth's surface, and extend to lengths reaching about 700-900 ft. horizontally from the well casing 102. Generally, any suitable waterjet 410 and hose 402 combination can be used so long as the waterjet 410 and hose 402 can negotiate the approximate 90° turn in a radius of about 7 in. to about 14 in. Intuitively, however, the hose 402 should have an inner diameter as large as possible to minimize pressure losses and yet maintain the flexibility to turn the approximate 90° corner required to enter the reamed-out perforation 114.

In exemplary operation, the hose 402 may have a working pressure rating to withstand about 20-40 gallons per minute (GPM) at about 8,000-12,000 psi pump pressure. After total line losses, the hose 402 may be capable of delivering about 8,000-10,000 psi to the nozzle 502. It has been shown that the commercially-available Power Track™ and SpirStar™ hoses meet the above-noted pressures and delivery criteria.

In an exemplary embodiment, the hose 402 may include at least two lengths (not shown). The two lengths may be of varying diameters, but may also be of a single diameter. A first length of hose 402 may be configured to extend into the formation 108 for cutting operations, and a second length may be coupled to the first length and configured to extend from the surface. In other embodiments, there may be two or more differing diameter hose 402 lengths that extend horizontally into the adjacent formation 108. Generally, any commercially-available high-pressure coupling may be used to connect the different lengths, and in most applications, suitable couplings may be acquired from the manufacturer of the waterjet 410.

It will be understood that the dimensions and proportional structural relations shown in the drawing figures are for exemplary purposes only, and that the figures do not necessarily represent actual dimensions or proportional structural relationships used in the methods herein described.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired Earth retaining structures. Therefore, the claims should be interpreted in a broad manner, consistent with the present disclosure.

We claim:

1. A waterjet guide, comprising:

an elongated housing having a first end and a second end, the elongated housing being configured to re-direct a flexible hose;

a tube plate disposed within the elongated housing proximate the first end, and a stop plate disposed within the elongated housing proximate the second end;

a diverter assembly disposed between the tube plate and the stop plate, the diverter assembly having an inlet curvature mounted adjacent the tube plate and a pivot curvature pivotally coupled to the elongated housing;

a mandrel with a pivot end and a threaded end, the mandrel being slidingly engaged within a barrel defined in the second end of the elongated housing, the pivot end being contactable with the stop plate to cease upward translation of the mandrel within the barrel; and a pivotable connector coupled to the pivot end of the mandrel and also coupled to the pivot curvature, whereby movement of the mandrel within the barrel forces the pivotable connector to pivot the pivot curvature between a stowed configuration and a deployed configuration.

2. The waterjet guide of claim 1, wherein the first end further comprises a threaded bore configured to threadably engage a drill string.

3. The waterjet guide of claim 1, further comprising a plurality of roller bearings disposed on the inlet and pivot curvatures, the plurality of roller bearings being configured to guide and rollingly engage the flexible hose as it moves within the waterjet guide.

4. The waterjet guide of claim 3, wherein the plurality of roller bearings comprise saddle bearings.

5. The waterjet guide of claim 3, further comprising:

one or more translation rollers disposed proximate the tube plate and opposite the roller bearings; and one or more guide rollers disposed opposite the roller bearings, wherein the one or more translation and guide rollers are configured to maintain alignment of the flexible hose within the diverter assembly and minimize erratic movement of the flexible hose.

6. The waterjet guide of claim 1, further comprising a guide plate disposed proximate the tube plate and adapted to direct the flexible hose through an opening defined in the tube plate and into the inlet curvature.

7. The waterjet guide of claim 1, wherein the stop plate ceases downward translation of the mandrel within the barrel when a portion of the pivot curvature bottoms out against the stop plate and thereby stops its rotation.

8. A method of drilling a lateral channel in a subterranean formation adjacent a wellbore, comprising:

suspending a waterjet guide in the wellbore adjacent the subterranean formation, the waterjet guide having a diverter assembly disposed therein, wherein the diverter assembly has an inlet curvature mounted to the waterjet guide and a pivot curvature pivotally coupled to the waterjet guide;

actuating the diverter assembly to pivot the pivot curvature into a deployed configuration by engaging a casing isolation device with a first end of a mandrel assembly to transfer an axial force to a second end of the mandrel assembly pivotally coupled to the pivot curvature with a pivotable connector, the casing isolation device being disposed within the wellbore below the waterjet guide;

directing a flexible hose terminating at a waterjet down the wellbore and into the waterjet guide, wherein the diverter assembly receives and re-directs the flexible hose and waterjet out of the waterjet guide and into the subterranean formation; and pumping a fluid through the flexible hose and waterjet to create the lateral channel hoisting the waterjet guide within the wellbore to remove the mandrel assembly from contact with the casing isolation device, thereby forcing the pivot curvature to return to a stowed position.

9. The method of claim 8, wherein the flexible hose can be manually translated within the subterranean formation.

10. The method of claim 9, further comprising manually translating the flexible hose back and forth within the lateral channel to increase forward thrust and flush out drilling particulates.

11. The method of claim 8, wherein the diverter assembly re-directs the flexible hose and waterjet about 90.degree, in about a 12 in, radius.

12. The method of claim 8, wherein the diverter assembly re-directs the flexible hose and waterjet about 90.degree, in about a 7 in, radius.

13. A waterjet guide assembly, comprising:

a housing having first and second ends;

a diverter assembly disposed between the first and second ends, the diverter assembly having an inlet curvature mounted to the housing and a pivot curvature pivotally coupled to the housing, wherein the inlet and pivot curvatures are configured to cooperatively form a curved transition surface for a flexible hose when the diverter assembly is in a deployed configuration;

a mandrel assembly comprising a mandrel at least partially disposed within a barrel defined in the second end of the housing and having a pivot end and a threaded end; and a pivotable connector pivotally coupled to both the pivot end of the mandrel and the pivot curvature, the pivotable connector being configured to rotate the pivot curvature into the deployed configuration when the threaded end of the mandrel biases a casing isolation device and thereby transmits an axial force to the mandrel and pivotable connector.

14. The assembly of claim 13, wherein the mandrel assembly further comprises a spacing tubular coupled to the threaded end of the mandrel, the spacing tubular being configured to bias the casing isolation device and transmit the axial force to the mandrel and pivotable connector.

15. The assembly of claim 13, further comprising:

a plurality of roller bearings disposed on the inlet and pivot curvatures and configured to rollingly engage the flexible hose as it translates through the waterjet guide; and one or more translation rollers and one or more guide rollers disposed opposite the roller bearings, wherein the translation and guide rollers are configured to maintain alignment of the flexible hose within the diverter assembly and minimize erratic movement of the flexible hose.

16. The assembly of claim 13, wherein the flexible hose is manually translated within the subterranean formation.

* * * * *